United States Patent [19]

Parr

[11] Patent Number: 4,838,626

[45] Date of Patent: Jun. 13, 1989

[54] SECURITY CONTAINER

[76] Inventor: Ken D. Parr, 5400 Mimosa La., Richmond, Tex. 77469

[21] Appl. No.: 204,760

[22] Filed: Jun. 10, 1988

[51] Int. Cl.[4] ..... A47B 63/00

[52] U.S. Cl. ..... 312/333; 312/319; 292/153

[58] Field of Search ..... 312/319, 322, 333; 292/145, 153, 175, 251; 70/63, 85, 86

[56] References Cited

U.S. PATENT DOCUMENTS

| | | | |
|---|---|---|---|
| 699,301 | 5/1902 | Fogel | 292/153 |
| 1,176,259 | 3/1916 | Williams | 312/311 |
| 1,337,554 | 4/1920 | Harris | 292/153 |
| 1,450,974 | 4/1923 | Heotes | 321/333 |
| 1,885,186 | 5/1930 | Defoy | 292/175 |
| 2,379,157 | 6/1945 | Jones | 312/333 |
| 3,592,521 | 7/1971 | Cox | 312/333 |
| 4,003,614 | 1/1977 | Geer et al. | 312/319 |
| 4,006,951 | 2/1977 | Geer et al. | 312/333 |

*Primary Examiner*—Peter R. Brown
*Assistant Examiner*—Brian K. Green
*Attorney, Agent, or Firm*—Bill B. Berryhill

[57] ABSTRACT

A security container including a housing and a drawer disposed therein for movement from a recessed position, in which any contents of the drawer are inaccessible, to an extended position in which the contents of the drawer are accessible. A latch assembly carried by the housing and drawer is operable externally thereof to release the drawer for movement from the recessed to the extended position. A blocking device, carried by the housing, prevents operation of the latch assembly unless the blocking device is properly positioned.

17 Claims, 2 Drawing Sheets

SECURITY CONTAINER

BACKGROUND OF THE INVENTION

1. Field of the Invention

The present invention pertains to security containers. More specifically, the present invention pertains to secured containers especially useful in safely storing a pistol or other type of firearm and preventing unauthorized access thereto.

2. Brief Description of the Prior Art

Many individuals own or possess a pistol or other firearm for hunting, protection, sport, etc. This is particularly true in the United States under the Constitution of which the right to bear arms is guaranteed. While such firearms are relatively safe in the possession of law abiding persons knowledgable in their use, they can be extremely dangerous in the hands of a criminal, a child or other person not qualified for an appropriate use. Many individuals are killed or injured in their own homes due to accidental discharge of weapons by those unauthorized to use them. Accordingly, most prudent individuals attempt to secure or lock their firearms within a security container of some type.

Guns are frequently stored in safes, chests, chest-of-drawers, gun cases, etc. To prevent unauthorized access thereto, these containers may be provided with locks or latches of some type. One type of lock so used is the combination lock. However, combination locks may require an opening time unacceptable for individual protection from an intruder. In addition, most combination locks require sight of numbers thereon. This may be impractical or dangerous particularly where a light must be turned on.

Other locks or latches require keys, which are not always quickly available when needed. Futhermore, a child or other unauthorized individual may seek and find the key which opens the container in which the firearm is stored. Thus, while a number of locking or latching devises are available, many of them have characteristics which are not totally acceptable.

An ideal container for a firearm is one which is securely fastened but which may be quickly and easily opened by the owner or other authorized person. The search continues for such containers which are safe but practical to utilize.

SUMMARY OF THE PRESENT INVENTION

In the present invention an improved security container is disclosed which is especially useful in housing or storing a pistol or other firearm therein. The container is of the type having a housing in which is disposed a drawer which is movable from a closed position within the housing, in which any contents of the drawer are inaccessible, to an open position in which the contents of the drawer are accessible. A latch assembly is carried by the drawer and housing and is operable externally of the housing to release the drawer for movement from the closed position to the open position. However, the improved container of the present invention also includes a blocking device carried by the housing to prevent unauthorized operation of the latch assembly and opening of the drawer.

The latch assembly of the present invention preferrably comprises a sliding element carried by the drawer which is movable from a position engaging a fixed element attached to the housing to a nonengaging position in which the drawer is released for movement to the open position. In a preferred embodiment of the invention, movement of the sliding element of the latch assembly to the nonengaging position is prevented unless the blocking device is selectively positioned.

The blocking device of the present invention includes a rotating element carried by the housing and engagable with a fixed element carried by the drawer preventing movement thereof. However, the rotating element is rotatable to a predetermined position in which at least some movement of the drawer is permitted, such movement also allowing operation of the latch assembly for release of the drawer.

The security container of the present invention is especially suitable for storing of a hand gun rendering it inaccessible to anyone except those instructed and authorized to open the container. Opening the container requires simultaneous operation of the latch assembly and the blocking device. The blocking device must be moved to a predetermined position before the latch assembly can be operated. In fact, three conditions must occur before the container can be opened: the blocking devices must be selectively positioned, force must be applied to the latching assembly and the drawer of the container must be moved slightly in a direction away from the direction of opening. All of these conditions must occur simultaneously.

For one knowing the proper positions and conditions, opening is quite simple and quick. Futhermore, the container may be opened in the dark without a key and without having to operate a combination that requires memory and sight. Yet, the container is quite safe preventing access to anyone who does not know the sequence of the conditions of opening. Many other objects and advantages of the invention will be apparent from reading the description which follows in conjunction with the accompanying drawings.

BRIEF DESCRIPTION OF THE DRAWINGS

FIG. 1 is a perspective view of a security container according to a preferred embodiment of the invention, especially suitable for storing of handguns and the like;

DESCRIPTION OF A PREFERRED EMBODIMENT

Figure 1:
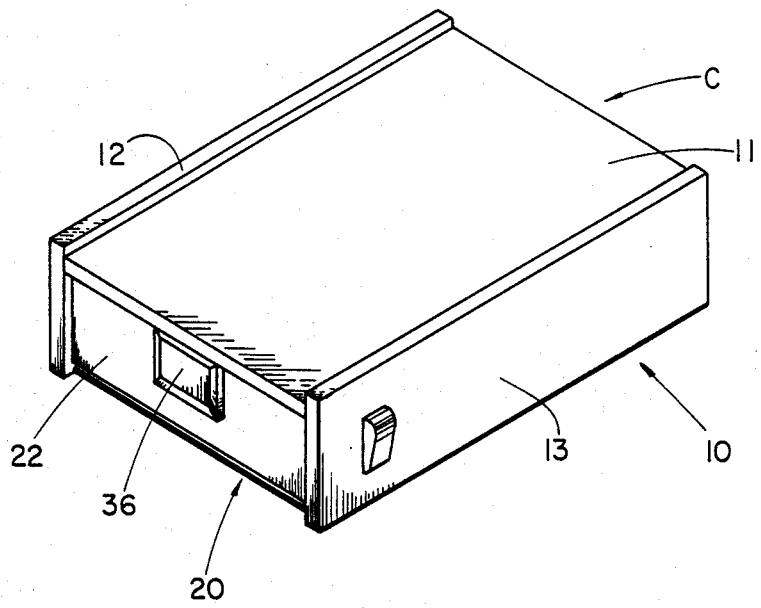
Figure 2:
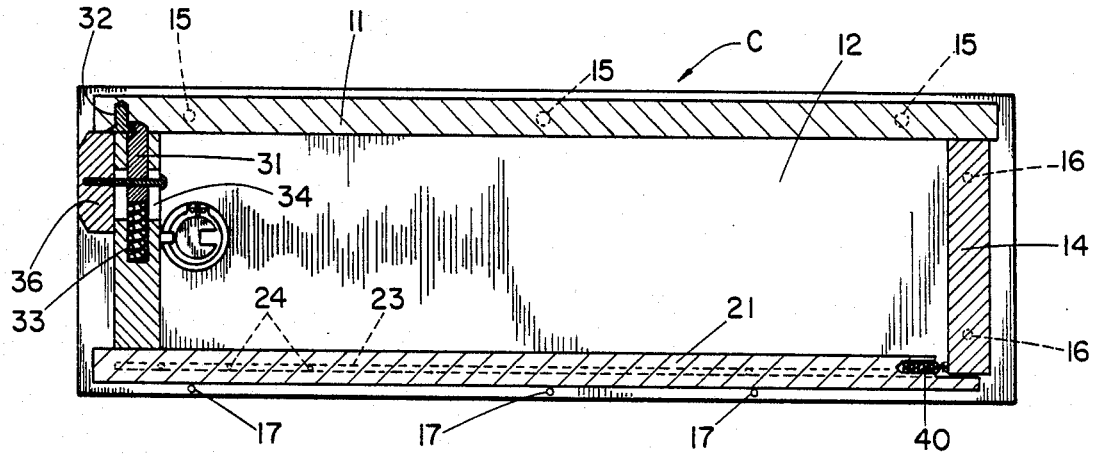
FIG. 2 is a side elevation view, in section, of the security container of the present invention according to a preferred embodiment thereon.
Figure 3:
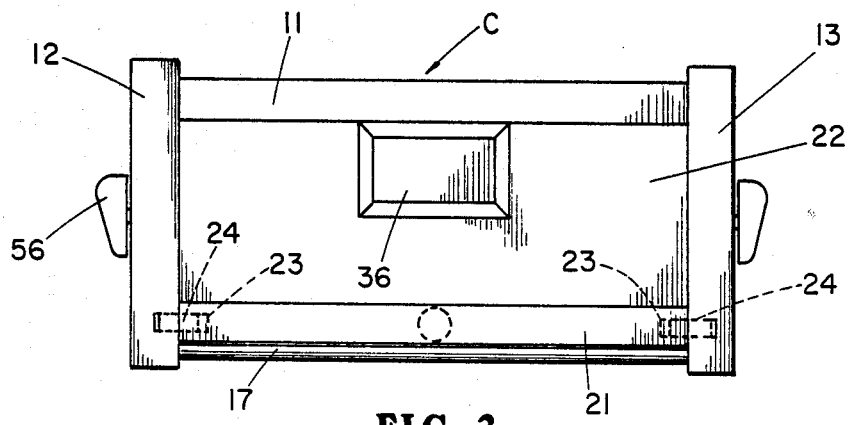
FIG. 3 is a front elevation view of the security container of FIGS. 1 and 2.
Figure 4:
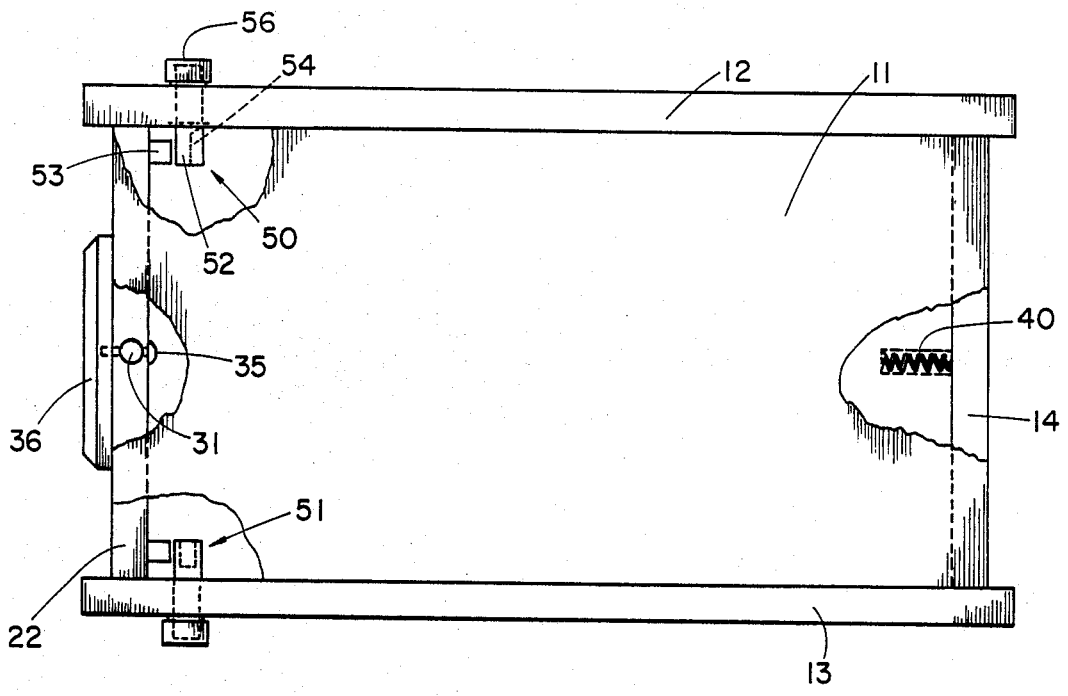
FIG. 4 is a top view of the security container of FIGS. 1, 2 and 3, portions of which have been removed to illustrate details thereof.

Referring first to FIGS. 1, 2, and 3 there is shown a security container or case C according to a preferred embodiment of the invention. The container C includes a housing 10 and a drawer 20. In the preferred embodiment the housing 10 comprises a top panel 11, two side panels 12, 13 and a back or rear panel 14. These panels are joined together in any suitable manner such as by gluing and/or with dowel pins 15, 16. Screws could also be used. In the preferred embodiment, steel rods or bars 17 are also used as connectors or spacers between lower portions of side panels 12 and 13. These components thus form the housing 10.

The drawer 20 includes a bottom panel 21 and a front panel 22. The drawer 20 is movable from a closed position, as illustrated in FIGS. 1, 2 and 3, in which any contents of the drawer are inaccessible, to an open position (not shown) in which the contents of the drawer are accessible. To provide means by which the drawer 20 can move between the closed and open positions, the edges of the bottom panel 21 are provided with recesses 23 (see also FIG. 5) and each of the housing sides 12 and 13 are provided with cooperating pins 24 for sliding engagement therewith. When the drawer moves in and out the slot 23 and pins 24 serve to guide the drawer in maintaining its horizontal disposition.

Figure 5:
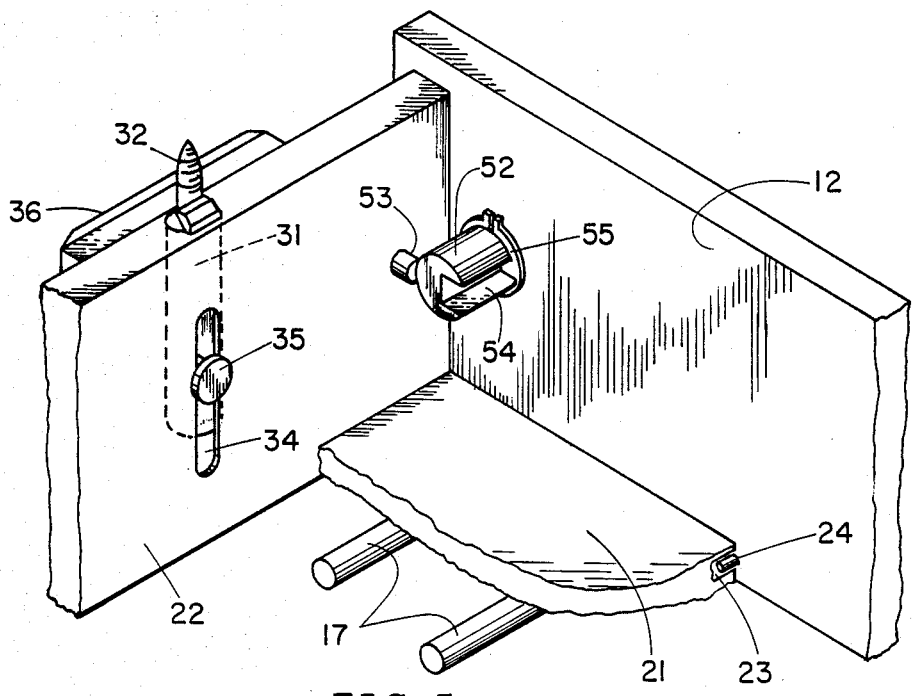
FIG. 5 is a perspective view of portions of the security container of FIGS. 1, 2, 3 and 4, for illustrating operation of various components and assemblies thereof.

As best seen in FIGS. 2 and 5, the drawer front 22 carries the major elements or components of a latch assembly which in this embodiment includes a sliding element 31 carried by the drawer and a fixed element 32 carried by the housing 10. The fixed element, in the exemplary embodiment, is actually a screw 32 screwed into top panel 11 and having a head thereon which engages a slot provided at the upper end of a sliding element 31. The sliding element 31 is mounted in a vertical hole provided in the drawer front 22 and the bottom of such hole is provided with a spring member 33 which biases the sliding member 31 toward its upper or engaged position with the fixed element 32. The drawer front is provided with a vertical slot 34 through which a screw member 35 passes for attachment to a handle 36. If the sliding element 31 were not engaging the fixed element 32, the handle member 36 could be used to move the sliding element 31 downwardly, against the bias of spring 33 to a recessed or nonengaging position. However, as shown in FIGS. 2 and 5, this is not possible since the slot of the sliding element 31 is in engagement with the head of the fixed element 32.

To allow disengagement of the sliding member 31 with the fixed element 32, the drawer 20 first requires some movement of the drawer in a direction opposite of the movement toward the open position. The drawer 20 is actually biased toward the position of FIG. 2 by a spring member 40 which is received within a cylindrical recess at the rear edge of the bottom panel 21. The spring also bears against the rear panel 14 of the housing. To produce the slight movement of the drawer 20 in a direction opposite the movement toward the open position, pressure would be applied in a direction toward the rear thereof to overcome the bias of spring 40. Upon sufficient movement, the sliding element 31 would be displaced enough so as to allow the sliding element 31 to disengage the fixed element 32. This, of course, is accomplished by pushing downwardly on the handle 36 with the fingers while the drawer 20 is forced against the spring 40. Once the sliding element 31 is in the nonengaging or disengaged position, the drawer 20 can then be opened, as long as the sliding element 31 is held in its disengaged position by pressure on the handle 36.

Provided on at least one side of the housing 10, and in the exemplary embodiment both sides 12 and 13, are a pair of blocking assemblies 50 and 51. The purpose of the blocking assemblies is to prevent operation of the latch assembly except by an authorized individual who knows how to selectively position the blocking assemblies 50 and 51. Each of the blocking assemblies, as described with reference to assembly 50, comprises a rotating element 52 carried by the housing and a fixed element 53 carried by the drawer. The rotating element 52 is a cylindrical member which extends through a hole provided therefor in the side panel 12. The end of the rotating member 52 within the housing is provided with a recess 54 which normally is not in registration with the fixed element 53. The cylindrical member 52, once placed through the hole provided therefore is fitted with a snap ring 55 to prevent its removal. A handle 56 is attached to the opposite end of the rotating element 52 and is engagable from the exterior of the housing. By manipulating the handle 56, the rotating member 52 can be rotated to any selected position.

Assuming that the drawer 20 is closed as shown in the drawings, the contents, e.g. a handgun, are inaccessible, the housing 10 and drawer 20 creating a totally enclosed container therefor. To open the drawer so as to have access of the contents thereof, the drawer 20 must be moved slightly to the rear so as to allow release or nonengagement of the latch assembly. Before this can be done, both of the blocking assemblies 50, 51 must be rotated by their associated handles until the recesses 54 on the end of the rotating elements 52 are in registration with the fixed elements 53 of the drawer. It will be noted that these positions can not be visually determined from outside of the housing 10. It can only be done by someone who knows which position they should assume. It will also be noted that the orientation of one rotating element 52 relative to its fixed element 53 is different from the orientation of the other elements of the other rotating assembly 51. It will be further noted that the handles 56 are made so that their centers of gravity are displaced from the axis of the rotating element 52 so that the handle member and the rotating element gravitate to a position other than the preselected or registration positions.

To open the drawer 20, the blocking assemblies 50, 51 must be moved to their preselected positions so that the recesses thereof register with the fixed elements of the drawer, allowing the drawer to be slightly recessed or moved slightly away from the direction of opening. At the same time pressure is applied downwardly on the handle 36 so that the sliding element 31 of the latch assembly disengages the fixed element 32 of the latch assembly. Once this occurs, the inwardly directed force on the drawer can be released and the spring 40 will force the drawer toward its open position. Once the drawer has moved toward the open position so that the sliding element 31 of the latch assembly has passed the fixed element 32 thereof, the drawer can be completely opened and the downwardly directed force on the handle 36 can be released. Of course, with the drawer open, the contents thereof are accessible.

To completely close and lock the drawer, the drawer is returned toward its closed position. However, to reengage the latch assembly thereof, the blocking assemblies 50 and 51 must again be positioned so that the recesses 54 register with the fixed element 53 of the drawer, this allows the drawer to move slightly past its normally closed position and allows the sliding element 31 to move to its closed or nonengaging position. Once this occurs, the forces applied to the handle 36 and drawer 20 and the positioning of the blocking assemblies 50 and 51 can be released and disregarded.

From the foregoing discription it can be seen that the security container of the present invention can be opened only on the simultaneous occurance of three events: rearwardly directed pressure on the drawer 20, downwardly directed pressure on the handle 36 of the latching assembly and preselected positioning of the blocking assemblies 50, 51. Once this occurs, the latching assembly can be disengaged and the drawer opened. As one can see, the drawer is fairly simple to operate but only by one who knows the proper or preselected positions of the blocking assemblies 50, 51 and the two other simultaneous events that are required. Since the blocking assemblies 50, 51 do not function at the same angular orientation, it is almost impossible for one not knowing the necessary events to open the security container or case. Thus, unauthorized individuals, particularly children, can not obtain access to the container.

While a single preferred embodiment of the invention has been described herein, many variations thereof can be made without departing from the spirit of the invention. Accordingly, it is intended that the scope of the invention be limited only by the claims which follow.

I claim:

1. An improved security container comprising a housing and a drawer disposed therein, said drawer being forwardly movable from a recessed position within said housing, in which any contents of said drawer are inaccessible, to an extended position in which the contents of said drawer are accessible, wherein said improvement comprises:

latch means carried by said drawer and said housing and operable externally thereof to release said drawer for movement from said recessed position to said extended position, operation of said latch means first requiring limited rearward movement of said drawer; and blocking means carried by said housing for preventing said limited rearward movement of said drawer and operation of said latch means and release of said drawer unless said blocking means is properly positioned, said blocking means comprising at least one rotating member carried by said housing and engageable with said drawer preventing said rearward movement thereof, said rotating member being rotatable to a predetermined position which allows said rearward movement of said drawer and operation of said latch means for said release of said drawer.

2. A security container as set forth in claim 1 in which one end of said rotating member is provided with a handle member engageable externally of said housing and by which said rotating member may be rotated to said predetermined position.

3. A security container as set forth in claim 2 in which the center of gravity of said handle member is displaced from the axis of said rotating member and assembled so that under the sole influence of gravity said handle will cause said rotating member to assume a position other than said predetermined position.

4. A security container as set forth in claim 1 in which said blocking means comprises first and second rotating members carried by said housing and engageable with said drawer preventing said rearward movement thereof, each of said rotating members being rotatable to respective predetermined positions which allow said rearward movement of said drawer and operation of said latch means for said release of said drawer.

5. A security container as set forth in claim 4 in which one end of each of said rotating members is provided with a handle member engageable externally of said housing and by which each of said rotating members may be rotated to their said respective predetermined positions.

6. A security container as set forth in claim 5 is which the center of gravity of each of said handle members is displaced from the axis of its respective rotating member, each of said rotating members and its associated handle member being assembled so that under the sole influence of gravity each of said rotating members will assume a position other than their said respective predetermined positions.

7. A security container as set forth in claim 6 in which the degrees of rotation of each of said rotating members from its said gravity assuming position to said respective predetermined position is different from the other.

8. A security container having a housing which includes a top panel, two side panels and a back panel; a drawer which includes a bottom panel and a front panel, said drawer being movable from a closed position within said housing in which any contents of said drawer are inaccessible to an open position in which the contents of said drawer are accessible; latch means carried by said drawer and said housing operable externally thereof to release said drawer for movement from said closed position to said open position; and blocking means carried by said housing preventing unauthorized operation of said latch means and opening of said drawer; said latch means comprising a sliding element carried by said drawer and a fixed element attached to said housing, a slot on one of said elements and slot engaging means on the other, said sliding element being movable from an engaged position in which said slot and slot engaging means are engaged and in which said drawer is held in said closed position, to a nonengaged position in which said slot and slot engaging means are not engaged releasing said drawer for said movement to said open position, said movement of said sliding element from said engaged to said nonengaged position first requiring some movement of said drawer in a direction opposite of movement from said closed to said open position to allow lateral displacement of said slot and slot engaging means, said some movement of said drawer being prevented except when said blocking means is selectively positioned.

9. A security container as set forth in claim 8 in which said blocking means comprises a rotating element carried by said housing engageable with a fixed element carried by said drawer to prevent said some movement of said drawer.

10. A security container as set forth in claim 9 in which said rotating element has a recessed area therein which, when said rotating element is rotated to a preselected positions, may receive said fixed element of said drawer to permit said some movement of said drawer to allow nonengagement of said latch means and movement of said drawer to said open position.

11. A security container as set forth in claim 10 in which said rotating element extends through a hole in one of said side panels of said housing, allowing rotatable operation thereof from externally of said housing.

12. A security container as set forth in claim 11 in which a handle member is attached to one end of said rotating element and by which said rotating element may be rotated to said preselected position.

13. A security container as set forth in claim 12 in which the center of gravity of said handle member is displaced from the axis of said rotating element so that said handle member and said rotating element gravitate to a position other than said preselected position.

14. A security container as set forth in claim 13 in which a handle member is attached to said sliding element of said latch means externally of said drawer and by which said sliding element may be moved from said engaging to said nonengaging position.

15. A security container as set forth in clam 14 in which said sliding element is biased toward said engaging position by biasing means, the opening of said drawer requiring simultaneous movement of said sliding element of latch means to said nonengaging position and said some movement of said drawer while said rotating element of said blocking means is held in said preselected position.

16. A security container as set forth in claim 8 including biasing means carried by one of said drawer and said housing and engaging the other to bias said drawer in a direction toward said open position.

17. A security container as set forth in claim 16 in which said biasing means comprises a spring member carried by said drawer.

* * * * *